US006528749B2

(12) United States Patent
Hori et al.

(10) Patent No.: US 6,528,749 B2
(45) Date of Patent: Mar. 4, 2003

(54) SWITCH ATTACHMENT STRUCTURE

(75) Inventors: Masahiko Hori, Niigataken (JP); Shuichi Taniguchi, Niigataken (JP)

(73) Assignee: Twinbird Corporation (JP)

( * ) Notice: Subject to any disclaimer, the term of this patent is extended or adjusted under 35 U.S.C. 154(b) by 0 days.

(21) Appl. No.: 09/934,500

(22) Filed: Aug. 22, 2001

(65) Prior Publication Data

US 2002/0043452 A1 Apr. 18, 2002

(30) Foreign Application Priority Data

Aug. 23, 2000 (JP) ..... 2000-258149

(51) Int. Cl.[7] ..... H01H 9/00

(52) U.S. Cl. ..... 200/293; 200/293.1; 200/332.2

(58) Field of Search ..... 200/85 R, 293, 200/293.1, 294, 295, 303, 307, 332.1, 332.2, 334, 61.41–61.44, 61.85

(56) References Cited

U.S. PATENT DOCUMENTS 3,780,246 A * 12/1973 Beckering et al. ..... 200/322
3,854,020 A * 12/1974 Glover et al. ..... 200/293.1
4,700,031 A * 10/1987 Claghorn et al. ..... 200/281
5,041,706 A * 8/1991 Osika et al. ..... 200/295
5,900,603 A * 5/1999 Brush ..... 200/293.1
6,133,695 A * 10/2000 Caya et al. ..... 315/118
6,246,176 B1 * 6/2001 Fai ..... 315/118
6,407,353 B1 * 6/2002 Fritzinger et al. ..... 200/334

FOREIGN PATENT DOCUMENTS

JP 11-250998 9/1999 ..... H01R/13/70

OTHER PUBLICATIONS

Extract from a brochure of K.K. Fujisoku entitled "Lever Rocker Switch", published Jan. 1992.

* cited by examiner

*Primary Examiner*—Michael Friedhofer
(74) *Attorney, Agent, or Firm*—Akerman Senterfitt

(57) ABSTRACT

A switch attachment structure for an electric appliance which is simple but is able to provide good assembling efficiency. A first outer shell (2*a*) which constructs a part of a main body or pillar (2) of the electric appliance is provided in a bottom with an attachment frame (8). The attachment frame (8) includes a through-hole (7) for attaching a tip-over switch (3) thereto and a cutout (9) formed in a part of the attachment frame (8). The cutout (9) has a width at least as large as the thickness of a lead wire (10), thus providing the communication of the through-hole (7) with the outside of the attachment frame (8). When combining the first outer shell (2*a*) and a second outer shell (2*b*) together, the cutout (9) is filled by the second outer shell (2*b*). Thus, it is possible to insert the lead wire (10) from the cutout (9) into the through-hole (7) with the switch (3), the lead wire (10) and the electrical element (11) being connected together beforehand, and then to insert the switch (3) into the through-hole (7) to thereby easily and efficiently attach the switch (3) to the attachment frame (8).

10 Claims, 7 Drawing Sheets

PRIOR ART

SWITCH ATTACHMENT STRUCTURE

BACKGROUND OF THE INVENTION a) Field of the Invention

The present invention relates to a switch attachment structure for an electric appliance such as an electric lighting apparatus.

b) Prior Art

One example of conventional switch attachment structure for an electric appliance is illustrated in FIG. 7, in which one of outer shells 102 that construct a pillar 101 is provided with an attachment frame 104 having a through-hole 103, into which is inserted a switch 105 so that it may be retained by the attachment frame 104. With the structure thus made, the switch 105 is kept retained by the attachment frame 104 during the assembly of the appliance, thus enhancing assembling efficiency.

According to the conventional switch attachment structure, however, one end of a lead wire must be connected to a terminal of the switch 105 with the switch 105 being attached to the attachment frame 104, or with the lead wire being inserted beforehand into the through-hole 103, or otherwise, the lead wire with its one end attached beforehand to the switch 105 must be first inserted into the through-hole 103 and then the other end thereof must be connected to electrical elements such as a circuit board or a socket. Accordingly, there has been a considerable room for improvement from a standpoint of assembling efficiency.

On the other hand, if the main body of a certain electric appliance is constructed by assembling at least two outer shells together, a switch might be able to be attached to the main body by clamping the switch between the two outer shells. In this case, although it is possible to attach the switch to the main body after the switch, the lead wire and the electrical elements are connected to one another, the switch is not retained during the assembling work, and thus there has also been a room for improvement from a standpoint of assembling efficiency.

SUMMARY OF THE INVENTION

To eliminate the above-mentioned problems, it is an object of the present invention to provide a switch attachment structure for an electric appliance which is simple but is able to provide a good assembling efficiency.

To attain the object, there is provided a switch attachment structure for an electric appliance, which comprises: a main body constructed by combining at least two outer shells together, one of said outer shells being provided with a through-hole defined therethrough; an attachment frame formed around an outer periphery of said through-hole; a switch attached to said attachment frame; an electrical element mounted to said main body; and a lead wire for electrically connecting said switch to said electrical element, wherein a part of said attachment frame is formed with a cutout, said cutout being filled by the other of said outer shells when said outer shells are combined together.

According to the structure thus made, it is possible to insert the lead wire from the cutout into the through-hole while mounting the electrical element to one of said outer shells, with the switch, the lead wire and the electrical element being connected together beforehand, and then to insert the switch into the through-hole from the outside of the one of said outer shells so as to retain the switch by the attachment frame, and finally to combine the other of said outer shells to the one of said outer shells to thereby fill the cutout.

From another aspect of the invention, there is provided a switch attachment structure for an electric appliance according to the foregoing aspect, wherein said cutout has a width at least equal to a thickness of said lead wire.

Accordingly, the lead wire can be easily inserted into the through-hole, without forcing the same into the cutout during the assembling work.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Figure 1:
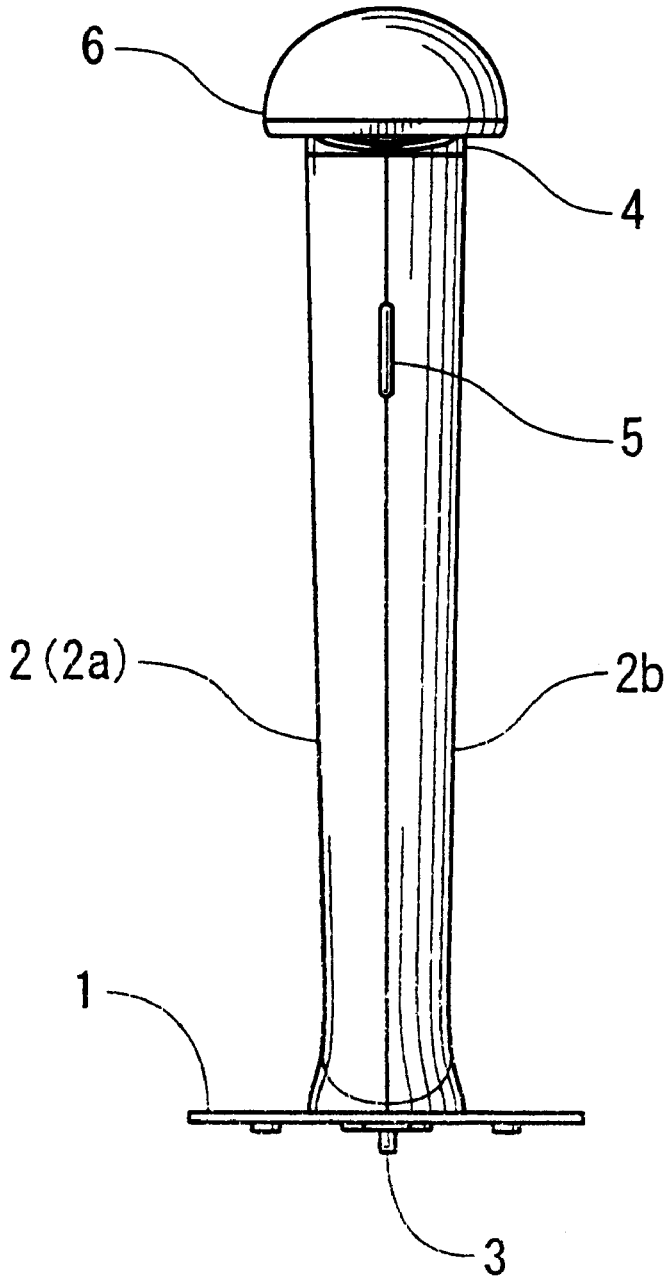
FIG. 1 is a front view showing an electric appliance with a switch attachment structure according to an embodiment of the invention.
Figure 2:
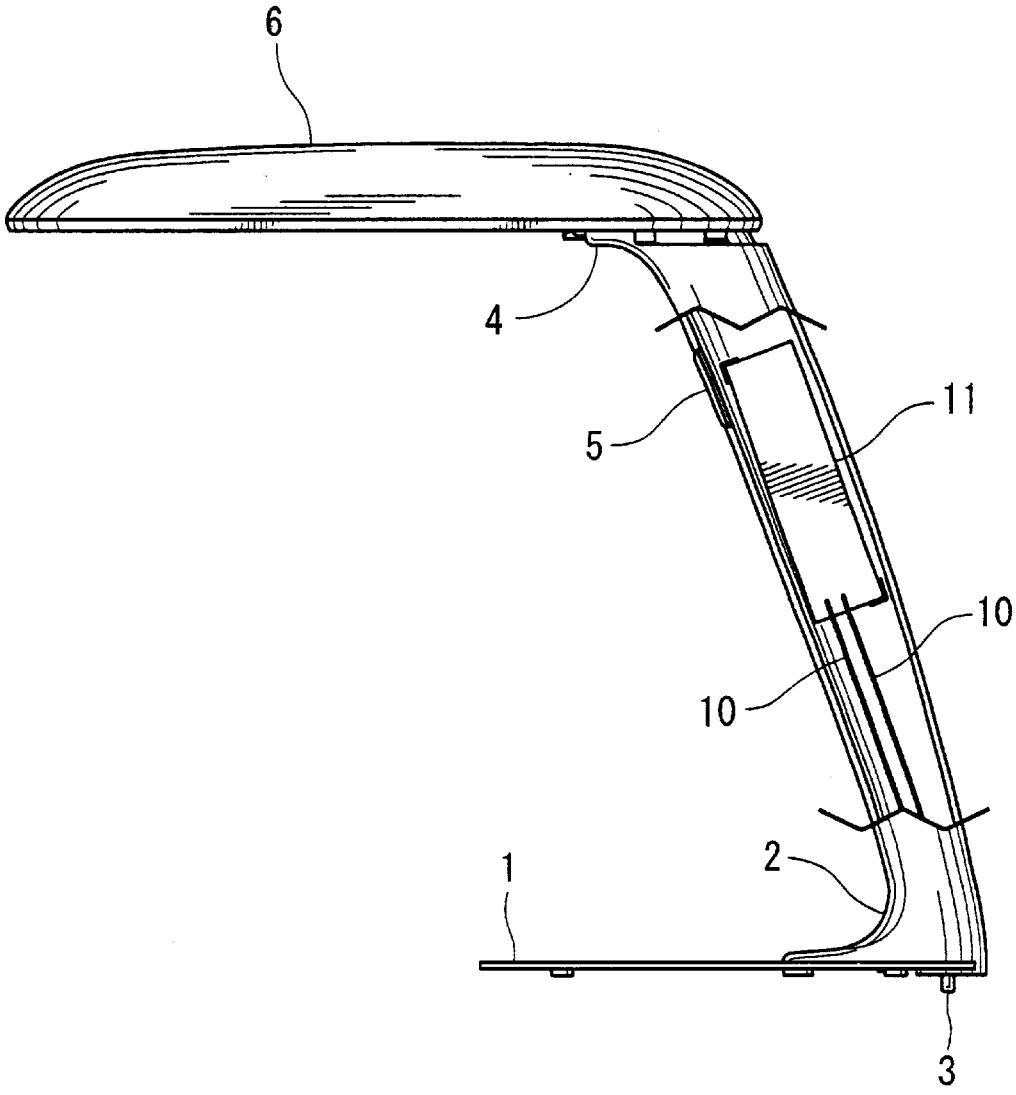
FIG. 2 is a partially cutaway section of the embodiment of FIG. 1.
Figure 3A:
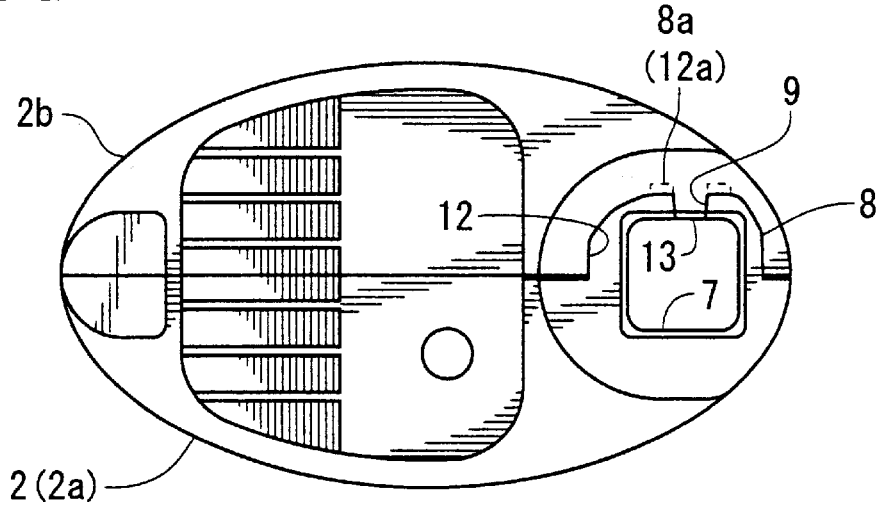
FIG. 3*a* is a bottom view showing a pillar of the electric appliance of FIG. 1, in which a tip-over safety switch is not attached yet.
Figure 3B:
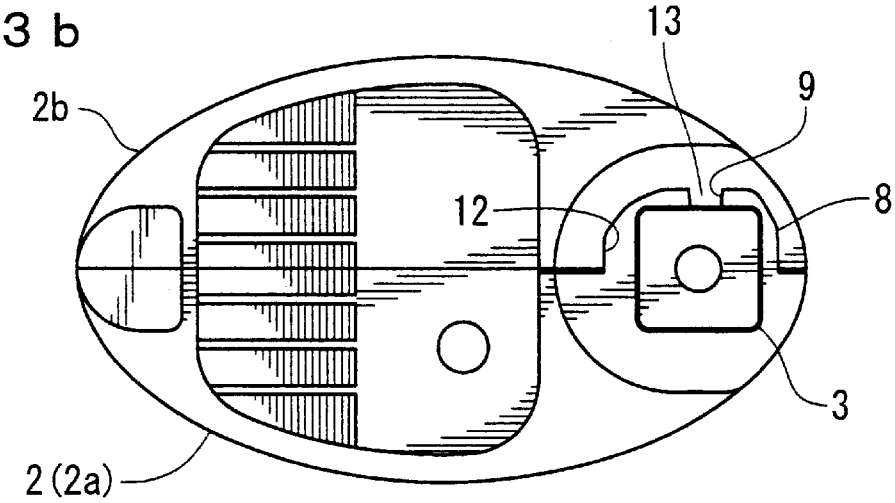
FIG. 3*b* is a bottom view showing the pillar of the electric appliance of FIG. 1, in which the tip-over safety switch is attached.

Hereinafter is described a preferred embodiment of the present invention with reference to FIGS. 1 through 3, in which an electric desk lamp is shown as an example of an electric appliance, and a tip-over safety switch as an example of the switch of the embodiment. Needless to say, the present invention is applicable to any other electric appliance and switch.

Reference numeral 1 designates a metallic plate base, having an end to which is removably mounted a pillar 2 as a main body. The pillar 2 comprises a tip-over safety switch 3 provided in a bottom, said switch 3 protruding downwardly from the base 1; and a head 4 integrally provided in a top thereof The pillar 2 further comprises a lighting switch 5. The head 4 is formed by bending the top portion of the pillar 2 to extend in the horizontal direction, while a shade 6 is detachably provided over the head 4.

Next, the detailed structure of the pillar 2 will de described. The pillar 2 is constructed by combining a left-side outer shell 2*a* with a right-side outer shell 2*b*. The outer shell 2*a* is provided in a bottom with an attachment frame 8 which includes a substantially square-shaped through-hole 7 and a cutout 9, said cutout 9 being formed in a part of the attachment frame 8, thus providing the communication of the through-hole 7 with the outside of the attachment frame 8. Thus, the square-pole-shaped, aforesaid tip-over safety switch 3 is attached to the through-hole 7. The tip-over safety switch 3 is formed at its side with a hook claw 3*a*, which engages with the inner peripheral edge of the attachment frame 8. Further, one end of a lead wire 10 is connected to a terminal 3*b* of the said switch 3, while the other end thereof is connected to an electrical element or circuit board 11.

In the meantime, the cutout 9 defines a width of which the dimension is at least equal to the thickness of the lead wire 10 but smaller than the length of one side of the through-hole 7 so that the cutout 9 can allow the lead wire 10 to pass therethrough. The outer peripheral edge of the attachment frame 8 is formed with a protrusion 8*a*. Although not shown in the drawings, the outer shell 2*a* is 16 formed with a plurality of bosses, to which is attached said circuit board 11. On the other hand, the other outer shell 2*b* is provided in a bottom with a recess 12, corresponding to the outer peripheral edge of the attachment frame 8, said recess 12 being formed with a receiving portion 12*a* for receiving said protrusion 8*a* and a projection 13 which is to be inserted into said cutout 9 for filling the same.

Figure 4:
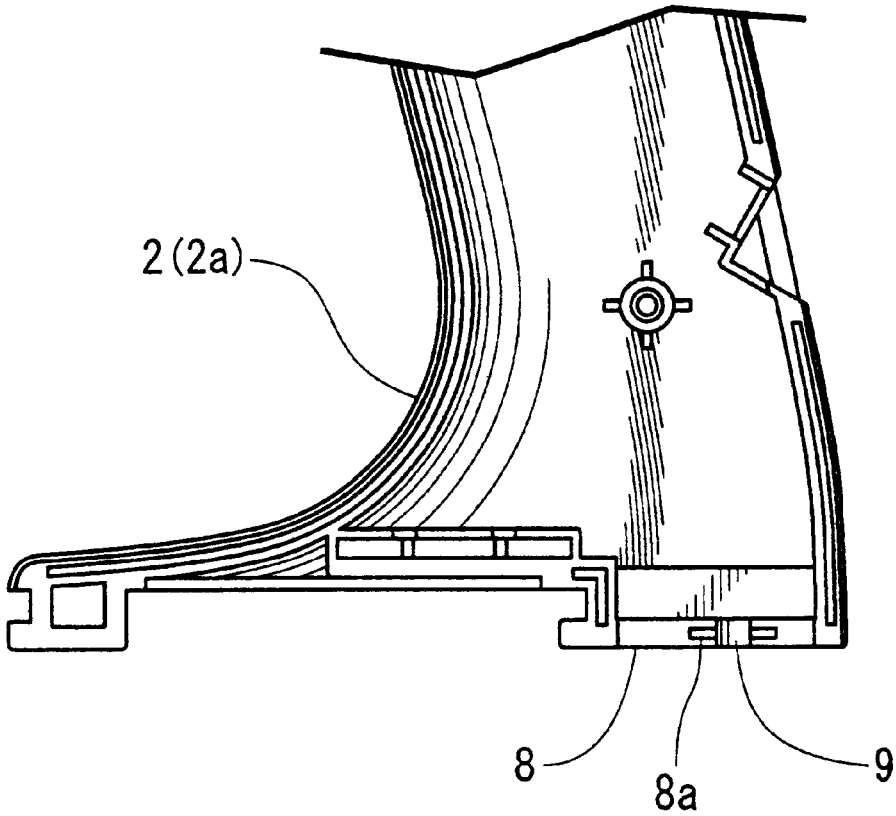
FIG. 4 is an explanatory diagram for illustrating an initial state prior to attaching the tip-over safety switch, for the purpose of explaining how to attach the tip-over safety switch.
Figure 5:
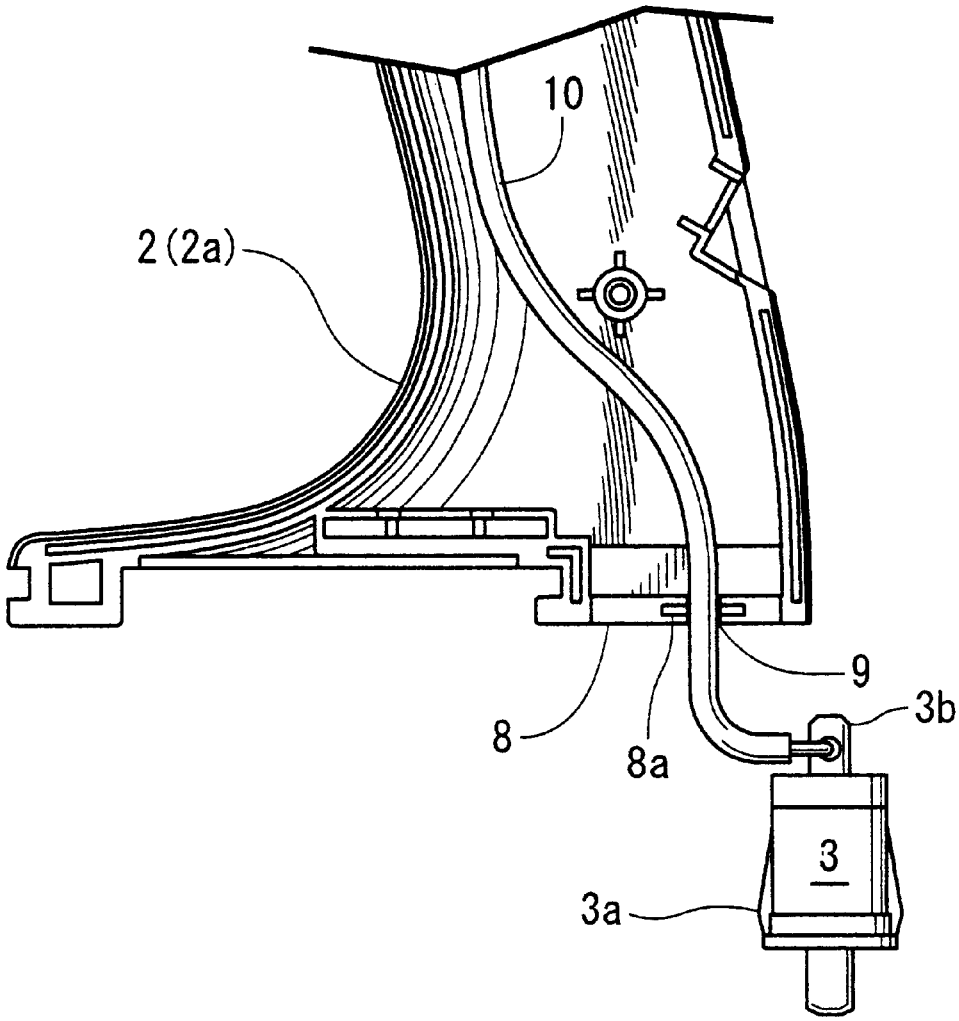
FIG. 5 is also an explanatory diagram for illustrating a state in which a lead wire is inserted from a cutout into a through-hole, for the purpose of explaining how to attach the tip-over safety switch.
Figure 6:
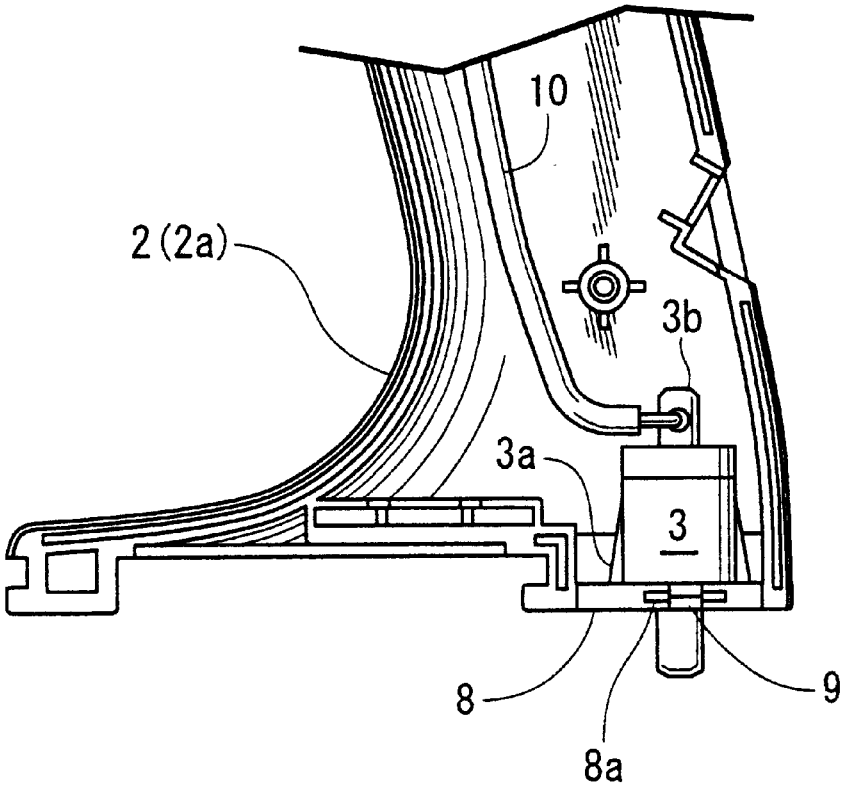
FIG. 6 is also an explanatory diagram for illustrating a state in which the tip-over safety switch is inserted into the through-hole, for the purpose of explaining how to attach the tip-over safety switch.
Figure 7A:
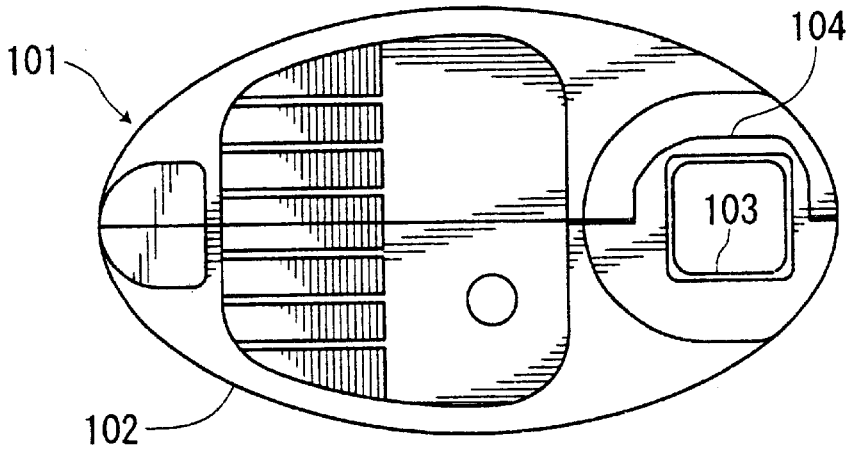
PRIOR ART FIG. 7a
FIG. 7*a* is a bottom view showing the pillar of a conventional electric appliance, in which the tip-over safety switch is not attached yet.
Figure 7B:
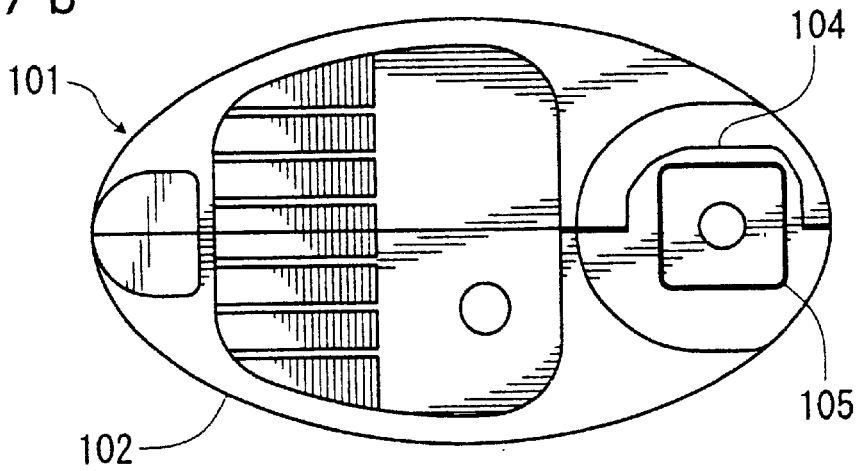
FIG. 7*b* is a bottom view showing the pillar of a conventional electric appliance, in which the tip-over safety switch is attached.

Next, an assembling process in the embodiment is described, with reference to FIGS. 4 through 6.

First, the terminal 3*b* of the tip-over safety switch 3 and a first end of the lead wire 10 are connected to each other by soldiering or the like, while a second end of the lead wire 10 is connected to the circuit board 11 by soldiering or the like as well. Then, the circuit board 11 is attached to the boss of the outer shell 2*a* by fastening screws or the like. Thereafter, as illustrated in FIG. 5, the lead wire 10 is inserted from the cutout 9 into the through-hole 7 so that the first end of the lead wire 10, i.e., one end of the lead wire 10 which is closer to the safety switch 3 may be located outside the outer shell 2*a*. At this moment, as the width of the cutout 9 is formed greater than or at least equal to the thickness of the lead wire 10, the coating of the lead wire 10 is prevented from being damaged by the cutout 9 when the lead wire 10 passes therethrough, and thus easy assembly with excellent reliability is achieved.

Subsequently, as illustrated in FIG. 6, the tip-over safety switch 3 is inserted from the outside of the outer shell 2*a* into the through-hole 7 so as to allow the hook claw 3*a* to engage the inner peripheral edge of the attachment frame 8, whereby the tip-over safety switch 3 is held in place by the attachment frame 8. Finally, the outer shells 2*a* and 2*b* are joined together, and fastened by screws or the like. At that time, the protrusion 8*a* formed in the outer peripheral edge of the attachment frame 8 is fitted into the receiving portion 12*a* formed in the recess 12 so that the attachment frame 8 is held in place, while the projection 13 is fitted into the cutout 9 to thereby fill the cutout 9.

According to the switch attachment structure of the invention, the first outer shell 2*a* that constructs a part of the pillar 2 is provided in the bottom with the attachment frame 8 having the through-hole 7 for attaching the tip-over safety switch 3, said attachment frame 8 including the cutout 9 which is formed in a part thereof, defining a width of which the dimension is at least equal to the thickness of the lead wire 10, thus providing the communication of the through-hole 7 with the outside of the attachment frame 8, while the cutout 9 is filled by the second outer shell 2*b*.

According to the structure thus made, it is possible to insert the lead wire 10 from the cutout 9 into the through-hole 7 with the tip-over safety switch 3, the lead wire 10 and the circuit board 11 being connected together beforehand, and then to insert the tip-over safety switch 3 into the through-hole 7, to thereby easily attach the switch 3 to the attachment frame 8.

Furthermore, as the cutout 9 is formed so as to define the width at least equal to the thickness of the lead wire 10, easy assembly with excellent reliability is ensured, without allowing the cutout 9 to damage the coating of the lead wire 10 during the assembling work.

Incidentally, the present invention should not be limited to the foregoing embodiments, but may be modified within the scope of the invention. For example, whilst the cutout 9 is formed so as to define the width at least equal to the thickness of the lead wire 10 in the foregoing embodiment, the width of the cutout may be less than the thickness of the lead wire if the elastic deformation of the attachment frame enables the passage of the lead wire without damaging the coating thereof. Alternatively, the cutout may be replaced with a small cut, provided that the amount of elastic deformation is insured. Taking the likelihood to damage the coating of the lead wire into consideration, however, it is desirable to form the cutout so that the width thereof may be greater than or at least equal to the thickness of the lead wire.

What is claimed:

1. A switch attachment structure for an electric appliance, which comprises:

a main body constricted by combining at least two outer shells together, one of said outer shells being provided with a through-hole defined therethrough;

an attachment frame formed around an outer periphery of said through-hole;

a switch attached to said attachment frame;

an electrical element mounted to said main body; and a lead wire for electrically connecting said switch to said electrical element, wherein a part of said attachment frame is formed with a cutout, said cutout being filled by the other of said outer shells when said outer shells are combined together.

2. A switch attachment structure for an electric appliance according to claim 1, wherein said cutout has a width at least equal to a thickness of said lead wire.

3. A switch attachment structure for an electric appliance according to claim 2, wherein an outer peripheral edge of said attachment frame is formed with a protrusion, while the other of said outer shells is provided in a bottom with recess, corresponding to said outer peripheral edge of said attachment frame, said recess being formed with a receiving portion for receiving said protrusion and a projection for filling said cutout.

4. A switch attachment structure for an electric appliance according to claim 2, wherein said switch is a tip-over switch, provided at one side with a hook claw to engage with an inner peripheral edge of said attachment frame.

5. A switch attachment structure for an electric appliance according to claim 1, wherein said attachment frame is elastically deformable so that said cutout may have a width less than a thickness of said lead wire.

6. A switch attachment structure for an electric appliance according to claim 3, wherein an outer peripheral edge of said attachment frame is formed with a protrusion, while the other of said outer shells is provided in a bottom with a recess, corresponding to said outer peripheral edge of said attachment frame, said recess being formed with a receiving portion for receiving said protrusion and a projection for filling said cutout.

7. A switch attachment structure for an electric appliance according to claim 3, wherein said switch is a tip-over switch, provided at one side with a hook claw to engage with an inner peripheral edge of said attachment frame.

8. A switch attachment structure for an electric appliance according to claim 1, wherein an outer peripheral edge of said attachment frame is formed with a protrusion, while the other of said outer shells is provided in a bottom with a recess, corresponding to said outer peripheral edge of said attachment frame, said recess being formed with a receiving portion for receiving said protrusion and a projection for filling said cutout.

9. A switch attachment structure for an electric appliance according to claim 1, wherein said switch is a tip-over switch, provided at one side with a hook claw to engage with an inner peripheral edge of said attachment frame.

10. A switch attachment structure for an electric appliance according to claim 9, wherein said tip-over switch is square-pole-shaped.

* * * * *